US005094770A

United States Patent [19]

Sheridan et al.

[11] Patent Number: 5,094,770

[45] Date of Patent: * Mar. 10, 1992

[54] METHOD OF PREPARING A SUBSTANTIALLY DRY CLEANING WIPE

[75] Inventors: Christopher H. Sheridan, Cresskill, N.J.; John A. Amann, Mount Vernon, N.Y.

[73] Assignee: Nordico, Inc., New York, N.Y.

[ * ] Notice: The portion of the term of this patent subsequent to Feb. 25, 2009 has been disclaimed.

[21] Appl. No.: 562,124

[22] Filed: Aug. 3, 1990

Related U.S. Application Data

[62] Division of Ser. No. 271,320, Nov. 15, 1988, Pat. No. 4,946,617.

[51] Int. Cl.[5] ..... C11D 11/00; C11D 1/62; C11D 1/835; C11D 17/06

[52] U.S. Cl. ..... 252/91; 252/90; 252/153; 252/171; 252/174; 252/174.21; 252/547; 252/DIG. 10

[58] Field of Search ..... 252/90, 91, 92, 106, 252/134, 153, 174, 174.21, 547, 171; 15/209 R; 206/812; 428/239, 245, 289

[56] References Cited

U.S. PATENT DOCUMENTS

| | | | |
|---|---|---|---|
| 3,227,614 | 1/1966 | Scheuer | 167/84 |
| 3,283,357 | 11/1966 | Decker | 15/506 |
| 3,786,615 | 1/1974 | Bauer | 53/471 |
| 3,839,234 | 10/1974 | Roscoe | 252/544 |
| 3,895,474 | 7/1975 | Bauer | 53/471 |
| 3,897,356 | 7/1975 | Pociluyko | 252/91 |
| 4,203,872 | 5/1980 | Flanagan | 252/542 |
| 4,257,924 | 3/1981 | Chester | 252/547 |
| 4,443,363 | 4/1984 | Klinger et al. | 252/547 |
| 4,448,704 | 5/1984 | Barby et al. | 252/91 |
| 4,587,154 | 5/1986 | Hotchkiss et al. | 428/195 |
| 4,624,890 | 11/1986 | Lloyd et al. | 428/290 |
| 4,666,621 | 5/1987 | Clark et al. | 252/91 |
| 4,692,374 | 9/1987 | Bouchette | 428/288 |
| 4,946,617 | 8/1990 | Sheridan et al. | 252/91 |

FOREIGN PATENT DOCUMENTS

| | | |
|---|---|---|
| 7244087 | 5/1987 | Australia . |
| 1056656 | 3/1986 | Japan . |
| 0760232 | 10/1956 | United Kingdom . |

*Primary Examiner*—Paul Lieberman
*Assistant Examiner*—A. Beadles-Hay
*Attorney, Agent, or Firm*—Rosen, Dainow & Jacobs

[57] ABSTRACT

A method of making a substantially flexible dry matrix capable of removing dust, organic film or both, to which no water has been added other than that naturally present therein, said matrix possessing anti-static properties and being capable of removing dust and retaining said dust on the surface threreof comprising uniformly contacting said which comprises passing a continuous line of a matrix material comprising (a) natural or synthetic woven, non-woven or knitted fibers, or (b) flexible foam material or combinations thereof with between an engraved roll and a smooth roll, said engraved roll containing a non aqueous treatment solution on the surface thereof; coating said matrix material with an effective amount of a non-aqueous treatment solution sufficient to allow said matrix to retain its substantially flexible dry characteristics and to remove said dust and organic film; said non-aqueous treatment solution comprising by weight between about 25% and 75% of at least one glycol compound and between about 0.2% and 60% of a cationic surfactant.

50 Claims, No Drawings

METHOD OF PREPARING A SUBSTANTIALLY DRY CLEANING WIPE

This is a division o application Ser. No. 271,320, filed Nov. 15, 1988, now U.S. Pat. No. 4,946,617.

FIELD OF THE INVENTION

The present invention relates to a substantially dry wipe which has incorporated therein a mixture comprising at least one glycol compounds and a cationic surfactant and optionally a nonionic surfactant. The dry wipe of the present invention can be used for a variety of different applications. For example, it can be used as a dust cloth to pick up and remove dust, fibers and other particulate matter while concurrently rendering the surface clean and substantially static free; in addition, the aforementioned wipe if immersed in water, acts as a hard surface cleaning wiper while concurrently rendering the cleaned surface substantially static free.

BACKGROUND OF THE INVENTION

One of the cleaning systems for "hard surfaces" (i.e., as exemplified by formica countertops and table tops, computer screens, kitchen appliances, porcelain bathroom surfaces) have sued solid or liquid soap, and currently preferably used detergents, which were applied to the surface with or without some scrubbing means.

In the past, liquid cleaners generally contained an active surfactant in addition to water, buffers, preservatives, thickeners, etc. Some of these liquid cleaners are designed to be diluted at the time of use with the dilution factors often being in the range of from 50 to 1 to 100 to 1.

Liquid cleaners were eventually modified to be used in the form of an aerosol or non-aerosol foam. The foams did not required dilution and therefore delivered more active cleaning chemicals to the surface to be cleaned. The action of the foam itself purportedly obviated the need to "scrub" the surface, however, these foams have not always worked as intended.

Another of the systems for cleaning hard surfaces comprised the use of scrubbing powders, such as sodium bicarbonate, as a carrier for the liquid surfactants used. These powders were diluted with fillers and various abrasive compounds. With the addition of a powdered bleaching agent to the abrasive powders, they gained a reputation of heavy duty hard surface cleaning.

The difficulty experienced in the prior art with the above-mentioned liquids, foams and powders to achieve a hard surface cleaning was to get the active ingredient to the specific area of the surface to be cleaned in full strength.

Obviously, the aforementioned systems were all liquid systems and would not be efficient for instances where it is desired merely to remove dust from the hard surface. The removal of dust from a hard surface depends upon an entirely different type of system, usually a system wherein, for example, a cloth is impregnated with oil or some other dust removing agent. These dust removing agents, while demonstrating a capacity to remove dust, are invariably incompatible with water so that the wet-dry systems mentioned above are mutually exclusive with respect to their use.

OBJECT OF THE INVENTION

It is a principal object of the present invention to provide a hard surface cleaning system wipe which can be used to dry to pick up and remove dust while rendering that surface static free and alternatively, with the addition of water to the wipe, to provide a cleaning system which can remove surface films which are predominately organic in nature.

It is another object of the invention to provide a cleaning system which is totally compatible with water while retaining its fully active properties regardless of whether the application is to remove dirt (dry system) or organic film (wet system).

SUMMARY OF THE INVENTION

The present invention relates to a substantially flexible dry wipe capable of cleaning a hard surface by removing dust, organic film or both and rendering it substantially static free, comprising a substrate, referred to herein as the "matrix", made up of natural or synthetic fibers, processed into woven, nonwoven or knitted forms, a flexible foam material, or any combinations thereof, which is uniformly coated with a treatment solution in an amount sufficient to obtain the benefits of the invention and yet still feel dry to the touch. With the aforementioned criteria in mind, the treatment solution can range between about 1 and 99%, preferably between about 3% and 25%, of basis weight of the matrix, said solution comprising between about 25% and 75% of at least one glycol compound, between 0.2% and 60% of a cationic surfactant, and optionally between about 5% and 45% of a nonionic surfactant. When the wipe is used to remove organic film, it must be first contacted with water by immersion or any other means irrespective of whether only the cationic surfactant or the cationic and nonionic surfactants are present in the wipe. Further, the solution may also optionally contain effective amounts of one or more fragrances, preferably between about 0.1% and 5% fragrance.

Such prior art references as U.S. Pat. Nos. 3,227,614, 3,283,357, 4,257,924, 4,692,374 and Australian Patent No. 72440/87 disclose systems of diluting active disinfectants and cleaning agents in a carrier, applying the surplus of the carrier containing the active ingredients onto a specific applicator material and subsequently drying the material with the carrier and active ingredient. These methods were used in the prior art because it was a convenient way to evenly disperse a specific amount of active ingredient on an applicator material.

For example, U.S. Pat. No. 3,227,614 uses a mineral oil as a carrier and adds an excess of detergent to counteract and emulsify the oily properties of the mineral oil carrier. The other references noted above use water, alcohol or combinations thereof, all followed by a drying step.

The product and method of the present invention is simpler, less expensive and applicable to a broader variety of matrix webs. Unexpectedly, the article of the present invention is safer than prior art products since it is practically non-irritating to the eyes, skin, etc.

DESCRIPTION OF THE PREFERRED EMBODIMENT

For the purpose of this specification, the term "substantially dry wipe" as used herein refers to a wipe to which no water has been added other than the water naturally present in the matrix as manufactured. The term further encompasses a wipe which has been treated with a nonaqueous 100% active solution containing the components described hereinafter which are applied to the matrix or web in such a way as to result in a product which feels dry to the touch.

As noted above, the matrix comprising the substantially dry wipe of the present invention contains natural or synthetic fibers, processed into woven, nonwoven or knitted form, a flexible foam, or combinations thereof, in a basis weight range generally of 5 to 200 grams per square yard preferably 15 to 100 grams per square yard. A suitable matrix of the present invention is comprised of woven or nonwoven thermoplastic filaments of fibers, more preferably polypropylene, in a basis weight range of 5 to 100 grams per square yard, preferably 15 to 40 grams per square yard, wherein the same filaments or fibers have a diameter preferably less than 4 microns. The tensile strength of the matrix of the present invention is of sufficient magnitude so as to enable the wipe to be used wet without shredding or disintegrating. It can be generally characterized by a tensile strength of between about 0.5 and 1.5 pounds per inch of width, although obviously lesser or greater values can be utilized. Such matrix can consist of a single layer of the filaments or fibers described above or a foam layer, or it can consist of a plurality of layers of the same said filaments or fibers and/or foam which have been adhered using any suitable method, such as sonic, thermal or mechanical bonding, etc. The aforementioned blends of the same or different types of fibers may be incorporated into the matrix depending upon the desired end use of the product. Selection of the matrix used pursuant to the present invention is dependent upon the cleaning efficiency and the type of application desired. Some factors to be considered with respect to the application to which the matrix will be put are the abrasive characteristics, absorbability characteristics, the porosity of the matrix and, obviously, the cost. In instances where a substantial capacity to hold liquid while in use in accordance with the present invention is desired, a flexible foamed material having high absorptive properties may be used, alone or in combination with the other materials noted above, as the matrix.

Of particular interest for use in the matrix are the following: (a) fibers: polypropylene, polyester, nylon and cellulosics, such as cellulose, cotton, rayon, hemp, etc.; (b) foams: polyurethane, polypropylene, polyethylene, polyester, polyethers, etc.

The cationic surfactant compound employed in the present invention can be selected form any of the well-known classes of water-soluble quaternary ammonium compounds. Such classes include the quaternary heteronium compounds such as cetyl pyridinium chloride and polymeric quaternary ammonium compounds of the general formula:

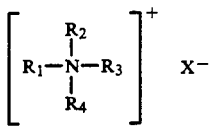

wherein $R_1$ and $R_2$ are selected from an alkyl group, an alkyl ether group and a hydroxyalkyl group each containing from 1 to 3 carbon atoms, $R_3$ is an alkyl group containing from 6 to 20 carbon atoms, and $R_4$ is selected from an alkyl group containing 6 to 20 carbon atoms, an aralkyl group wherein alkyl contains 1 to 2 carbon atoms and heterocyclic radicals, and $X^-$ is a suitable anion such as halide, e.g., chloride, bromide and iodide or nitrate, methosulfate or acetate.

A particularly useful compound having the general formula listed above is one wherein $R_1$ and $R_2$ are alkyl groups having 1-3 carbon atoms, $R_3$ is an alkyl benzyl group such as a dodecylbenzyl, $R_4$ is polypropylene oxide, and X is chloride.

Particularly useful quaternary ammonium compounds of the above-indicated general formula are the $C_{8-18}$ alkyl dimethyl ammonium chlorides and mixtures thereof.

The effective amount of cationic surfactant compound to be employed in accordance with the present invention ranges between about 0.20% and 60%, preferably between 40% and 60% of the treatment solution. The specific amounts of any particular cationic surfactant compound which may be employed within this range will depend on such factors relating to the intended end use of the wipe as can be readily determined by one of ordinary skill in the art.

The treating solution embodiments disclosed herein all required the presence of the glycol compounds specified hereinafter, which when moistened, exhibit nonionic surfactant properties. In addition, however, depending upon the specific end use to which the wipe of the present invention is to be put, the treating solution may also optionally contain up to 45% of a water-soluble nonionic surfactant in addition to the glycols specified herein.

Any of the well known classes of water-soluble nonionic surfactants may be employed in the invention.

Suitable nonionic surfactants include those selected from:

(a) the polyethylene oxide condensates of alkyl and dialkyl phenols, having a straight or branched alkyl group of from about 6 to about 12 carbon atoms, with ethylene oxide, wherein the amount of ethylene oxide present is from about 3 to about 25 moles per mole of alkyl phenol;

(b) the condensation products of aliphatic alcohols with ethylene oxide of the formula $RO(C_2H_4O)_nH$ and/or propylene oxide of the formula $RO(C_3H_6O)_nH$: wherein in either or both cases R is a straight or branched alkyl group having from about 8 to about 22 carbon atoms, and n is 3 to 40; and (c) polyoxyethylene polyoxypropylene block polymers.

Examples of nonionic surfactants of type (a) above are marketed by GAF Corporation under the trademark Igepal ®, e.g., Igepal ® CA-420, an octylphenol condensed with an average of 3 moles of ethylene oxide; or by Rohm and Haas under the trademark Triton ®, e.g., Triton ® X-100, an octylphenol condensed with an average of 9 moles of ethylene oxide.

Examples of nonionic surfactants of type (b) above are marketed by Shell Chemical Company under the trademark Neodol $^R$, e.g., Neodol ® 25-12, the condensation product of $C_{12-15}$ linear primary alcohol with an average of 12 moles of ethylene oxide, by Union Carbide Corporation under the trademark Tergitol ®, e.g., Tergitol ® 24L60, a polyethylene glycol ether of a mixture of synthetic $C_{12-14}$ fatty alcohols with an average of nine moles of ethylene oxide.

Examples of nonionic surfactants of type (c) above are marketed by BASF Wyandotte Corporation under the trademark Pluronic ® and Plurafac ®, e.., Pluronic ® 10 R5 which conforms to the formula $HO(CHCH_3CH_2O)_x(CH_2CH_2O)_y(CHCH_3CH_2O)_zH$ in which the average values of x, y and z are respectively 7, 22 and 7; and Plurafac ® B25-5, a linear straight chain primary alkoxylated alcohol.

When employed in accordance with the present invention, emulsifying effective amounts of nonionic surfactants are used; accordingly, the nonionic surfactants will be present up to about 45% of the treatment solution. The specific amount of the particular nonionic surfactant which is employed within this range will depend upon the detergent activity desired as can be readily determined by one of ordinary skill in the art; i.e., in applications requiring heavy duty cleaning power, higher amounts of nonionic surfactants in the treating solution would be used; and vice versa.

The dry wipe, optionally, but preferably may contain one or more fragrances for imparting a pleasant odor to the cleaned surface. As used herein, the term "fragrance" includes chemicals which can mask malodors and/or destroy malodors. When employed, the fragrance is present in the dry wipe in amounts up to 5% of the treatment solution.

The glycol, used in accordance with the present invention, is preferably propylene glycol, USP.

Any glycol, such as the propylene glycol USP disclosed above, which is safe and nontoxic and possesses the ability to coat fibers uniformly may be used. The glycols used must impart softness to the dry nonwoven web and, when diluted with water, increase the cleaning efficiency of the dry wipe by means of the water.

An illustration of a method used in the formation of a matrix capable of being utilized in the present invention comprises combining cellulosic wood pulp fibers, and synthetic fibers, such as a linear polyester. Such a matrix is formed by mixing the aforementioned fibers in water to form a slurry containing 1% to 5% by weight of the fibers. This slurry is discharged through a metering slot onto a continuously moving fine wire screen (commonly referred to as a Fourdrinier screen). The moving screen is continuously shaken in a lateral fashion, normal to its direction of movement, causing the fibers thereon to become mechanically entangled, and also causing a large portion of the water to be drained therefrom with the result that a moist, cohesive, weblike matrix is formed at the end of said wire screen. The resultant moist, weblike matrix is then dried and wound into rolls suitable for subsequent treatment.

The method described above for preparing the matrix permits flexibility because the basis weight of the matrix is easily varied by way of controlling the slurry discharge metering device. Furthermore, the use of slurries makes it easy to incorporate a wide variety of fibers therein.

Another method for preparing the matrix is by laminating a plurality of web layers, comprised of specified natural and/or synthetic fibers of the same or varying basis weights, by any of the commercially or commonly practiced methods used in the trade, such as for example, through the use of adhesives, heat bonding, flame bonding, sonic bonding or mechanical or hydraulic entanglement. These methods permit the use of a variety of layers in constructing the matrix.

Commercially manufactured matrices, as for example, "Sontara," a registered trademark of E. I. DuPont consisting of a mixture of cellulosic and synthetic fibers, normally supplied in a basis weight of 62 grams per square yard, are also suitable for the cleaning wipe of this invention.

The matrix, prepared in accordance with one of the methods described above, from which the cleansing wipe of the present invention is obtained, is coated and impregnated using a process wherein continuous rolls of said matrix are passed between an engraved roll and a smooth rubber roll under pressured nip contact. The engraved roll is constructed of steel or other suitable material whose surface has been engraved with a plurality of cells or cavities that are defined by specific shape and dimensions. Said shape and dimensions determine the volume of liquid picked up and held in the said cavities when in use.

During operation, the engraved roll is partially submerged in the cleaning solution described previously and rotates therethrough, causing said solution to fill the cavities of the engraved portions of said engraved roll. Excess solution accumulating above the plane of the engraving is removed by a doctor blade. The solution remaining in the cells of the engraved roll is caused to transfer by way of pressure absorption and surface tension into the matrix as its passes under pressure between said engraved roll and rubber roll.

Thereafter, the treated matrix, containing the measured volume of cleaning solution (which is capable of rendering the surface static free), is wound onto rolls and subsequently converted into the desired sheet or roll sizes and packed for distribution.

An important requirement of this method for treating said matrix with the wipe cleansing solution is that the lineal speed of the matrix passing through the nip formed by the engraved roll and rubber roll must equal the surface speed of the engraved roll. Furthermore, the rotation of the rolls must be in the same direction as the movement of the matrix.

Other methods of impregnating the matrix with measured amounts of wipe cleaning solution, such as by spraying, dipping, extrusion or by reverse roll, may also be used.

The coating/impregnation method described above enables a uniform and accurate application of all active ingredients to the woven or nonwoven matrix of natural and/or synthetic fibers or foam without the use of carriers and without the need for a separate step to dry the residual diluted solutions from the matrix.

Evaluation and testing of the wipe of the present invention, as detailed in the examples included hereinafter, clearly establishes tat the invention wipe differs from products found in the prior art in a number of ways. The formulation described and claimed herein consists of active ingredients only and no fillers, buffers or diluents are used. The particular active ingredients noted are dissolved in a nonaqueous component, thereby obviating the need of buffers, stabilizers and preservatives which are generally used in aqueous solutions for the purpose here described. The constituents comprising the solution present in the wipes of the instant invention are readily soluble in water when immersed therein.

An additional benefit not found in the prior art in using the article of the present invention, in the case of a wipe containing cellulosic fibers, allows one to rinse the wipe and squeeze out the excess water therefrom after its use as a dust wipe, and thereafter wipe the surface with the dampened wipe so that a "wiped dry" effect can be achieved on the hard surface.

More specifically, the benefit of the present invention resides in the use of a single wipe which is capable of being used in a variety of applications. As noted above, if one desires to dust and wash a hard surface, it is possible, using the article of the present invention, to dust the surface, then moisten the wipe with water, remove any surface film from the surface, followed by rinsing the wipe, removing the excess water and then using the wipe to dry the surface.

An additional characteristic is that the cleaning chemical and abrasive means, found separately in the prior art, as detailed above, are in this instance blended into a single article, i.e., the wipe. This wipe enables one to economically use specific surfactants, disinfectants and antistatic agents in combination, in the selected amounts desired, thereby surpassing any of the prior art products in either liquid or dry form.

EXAMPLE I

A matrix, comprising three sonically-bonded layers of a commercially available nonwoven web of polypropylene fibers wherein the polypropylene fibers in each layer are thermally bound together and possess a basis weight of 10 to 15 grams per square yard and was prepared so that the resultant bonded matrix had a basis weight of between 30 and 45 grams per square yard, was wound on a three inch core which was placed on an unwind stand and directed through an impregnating station consisting of an engraved printing roll having a pattern capable of applying the desired amount of treating solution to the matrix. The engraved roll partially immersed in the treating solution such that, as the roll turned, it picked up treating solution from the pan containing same and transferred the solution to the nonwoven matrix. The assure proper transfer to the nonwoven matrix, a pressure roll was mounted above the engraved roll. The process described which was used above is commonly called a "printing" process.

The treating solution which was impregnated into the matrix comprised a mixture of the following constituents:

| | |
|---|---|
| Propylene glycol U.S.P. | 49% |
| A mixture of a cationic surfactant including a propoxylated quaternary ammonium salt having the formula $R_1R_2R_3N^+X^-$ where $R_1$ and $R_2$ are methyl, $R_3$, $R_4$ is dodecylbenzyl and $R_4$ is a polypropylene oxide group and X is chlorine plus an alkyl phenylethoxylate nonionic surfactant) | 49% |
| Fragrance | 2% |
| Total: | 100% |

The nonwoven matrix was run through the printing process and picked up 3 to 4% of the treating solution, based on the basis weight of the matrix.

For the purpose of this example, after treatment the roll of treated nonwoven matrix was run through a Hudson-Sharp automatic folding machine which yielded wipes which were quarter folded. The resultant wipes were capable of being used as dust cloths which upon immersion into water, activated the surfactants contained therein to become wet cleaning cloths.

An experimental test was run which compared the wipe prepared as set forth above with three commercially available dust cloths to determine dust removal ability, residue left after dusting and ability to clean in the presence of water.

The tests run to evaluate these characteristics were based upon visual observations, and reflected actual situations found in real life. The dust removal test was conducted on an 18"×18" black glass surface. An incident light source was positioned at 45° to the glass surface to observe the amount of dust collected and, subsequently, to observe the amount of residue left after dusting. The results are set forth in Table 1.

TABLE 1

| | Dust Removal | Residue Left |
|---|---|---|
| A. Present invention | yes | none |
| B. Silicone treated commercial cloth | yes | light smear |
| C. Lemon oil treated commercial cloth | yes | heavy smear |
| D. Stretchable, extensible treated commercial cloth | yes | heavy smear |

The data shown in Table I indicates that the commercially available products such as silicon and/or oils such as mineral and lemon oils act as a "glue" by catching and holding the dust on the surface. For these products to work, excessive quantities of the oils are added to the cloth. This is the cause of the residue seen on the glass plate. The residue acts as an adhesive for any airborn dust and, in essence, increases the amount of dust trapped on furniture surfaces.

The ability to remove oily dirt by cleaning with water is demonstrated in Table 2 below. The cationic surfactant of the present invention is immediately available to the water and reacts as any good cleaning compound—it dissolves and emulsifies the dirt and oil and, when squeezed dry, wipes up the excess water and the emulsified dirt in one wipe. The propylene glycol is also immediately dissolvable in water and increases the cleaning action of the cationic surfactants by reducing the surface tension of the water and allowing the cleansing solution to penetrate hard-to-reach areas.

The commercially available dust cloths cannot clean a surface because they are incompatible with water and leave an oil-in-water smear behind. Even when squeezed "dry," they are oily and only create more dirt to be cleaned.

The cloth corresponding tot he cloth described above was used to dust a hard surface. Similarly, a cloth containing the same matrix described above was saturated with lemon oil instead of the solution of the present invention. The result showed a far superior result on the part of the cloth of the present invention insofar as the amount of dust picked up.

The ability of the wipe prepared above to clean in the presence of water was evaluated by immersing the wipe in water, squeezing it dry and then wiping it over soiled and smudged painted wood and metal surfaces which included door jambs and switch plates. The results in Table 2 set forth below showed that only the wipes of the present invention remove the dust and hand oils on the surfaces.

TABLE 2

| | Cleaning Ability |
|---|---|
| A. Present invention | acceptable |
| B. Silicone treated commercial cloth | none |
| C. Lemon oil treated commercial cloth | none |
| D. Extensible treated commercial cloth | none |

EXAMPLE II

This example demonstrates the use of the formulation of the present invention containing quaternary ammonium compounds as the cationic surfactants in the composition in contact with matrix.

A wiper similar to that in Example I was used in this experimental test except the matrix was composed of rayon fibers adhered to one another by a hydro-entangled process commonly used to mechanically entangle fibers by forcing water through the matrix at high pressure. A matrix of this type is commercially available form various nonwoven fabric manufacturers. The basis weight of this matrix is 80–90 grams per square yard.

The method of application is the same as described in Example I.

The impregnating solution in this case is as follows:

| | |
|---|---|
| Propylene Glycol U.S.P. | 63% |
| Plurofac D-25 | 10% |
| Plurofac B-25-5 | 10% |
| Amine Oxide | 10% |
| The cationic surfactant of Example I | 5% |
| Fragrance | 2% |
| Total: | 100% |

This impregnating solution was added to the web at a level of 6–8% of basis weight of the web.

The tests detailed in Example I were conducted using the wipe prepared according to this Example II. The results were substantially identical to those obtained and set forth in Table 1 of Example I.

The uniqueness of this embodiment is that the dry dust cloth, when used, e.g., to remove dust from glass surfaces, such as television and computer screens, can be rinsed in water after use to remove the dust and, once wetted, becomes a heavier duty cleaning cloth than the cloth disclosed in Example I. An added characteristic is that the wet cloth disclosed in this Example II, when squeezed dry, will pick up and remove all moisture on a moisture-impervious surface leaving it dry and streak-free.

EXAMPLE III

A wiper has prepared which combined the synthetic polypropylene material disclosed in Example I above with a natural cellulose fiber.

The structure of the wiper comprised a cellulose towel stock having a basis weight of 5 to 10 grams per square yard between two polypropylene webs of the type and having the characteristics of the nonwoven polypropylene webs described in Example I. The layers were adhered by a sonic bonding technique. The resultant web weighed between 30 to 40 grams per square yard.

Using the impregnating formula and the method of application disclosed in Example I, the resulting wipes were tested for cleaning ability and the identical results were obtained as those shown in Table 1 of Example I.

EXAMPLE IV

A wiper was prepared comprising the rayon fibers described in Example II sandwiched between top and bottom layers of the commercially available nonwoven polypropylene webs described in Example I. The resultant web weighed between 30 to 40 grams per square yard. Using the same impregnating formula and method of application disclosed in Example I, a test surface was wiped with the cloth of Example III and compared with the results of the three other sample cloths disclosed in Table 1. The same results as found in Table 1 of Example I were obtained.

Examples I–IV clearly indicate that the makeup of the matrix is not critical to the success of the product, however, the specific combination of layers does allow for some specified uses which are dictated by the characteristics of the web.

EXAMPLE V

A matrix was formed by an "airlay" process which suspends cellulosic fibers and accumulates then in a stream of air and collects them on a screen.

The fibers were adhered by means of acrylic type binders which were sprayed on the total matrix and then dried. This type of matrix is generally commercially available.

The matrix used in this example weighed 81 grams per square yard.

The matrix, as described, was treated with the following solution in accordance with the printing process detailed in Example I.

The impregnating solution in this example consisted of:

| | |
|---|---|
| Propylene Glycol U.S.P. | 35.61% |
| Plurofac D-25 | 13.88% |
| Amine oxide | 13.88% |
| Cationic surfactant of Example I | 36.61% |
| Fragrance | 0.02% |
| Total: | 100.00% |

The impregnating solution was applied to the matrix at a level of 12–15% of the basis weight of the matrix.

A cleaning efficiency test was designed to mimic what a homemaker might encounter. The results of this test are found in column iii, Table 3, hereinafter.

The cleaning efficiency test was as follows. Two ml. of vegetable oil was applied to a glass plate with a pipette, and the oil was spread about the surface with a serrated edge strip; samples of ketchup, mustard and a mayonnaise mixture (1:1:1) were applied to surfaces other than glass, using a plastic template. In each instance, the sample material was allowed to stand for 30 minutes. Then, using a moistened test wiper and the standard wetting technique, the surface was wiped with the moistened wiper. The number of wiping motions needed to clean the surface was recorded along with visual observations of residue remaining on the surface. The test was repeated five times.

The control found in column i, Table 3, used a HandiWipe ® and Joy ® liquid detergent (the Joy ® was diluted with water as per instruction) to demonstrate the efficiency in removing normal kitchen debris from various surfaces. The control required additional wiping after food debris was removed to remove all the excess suds left on the surface. The sample of the present invention removed both debris and foam at all times.

EXAMPLE VI

Having shown in previous examples that substantially dry wipers can act as dust cloths and, when wetted, act as detergent cleaning cloths suitable for spot cleaning or kitchen cleaning, the following examples show a unique product which can also demonstrate a disinfectant properties along with the detergent properties which it possesses.

Three separate matrices were used in this example. Three matrices comprised the materials cited in the following categories: (A) Example II (rayon, hydro-entangled basis weight of 90 grams per square yard); (B) another product identical in composition to Example V, but having a basis weight of 35–40 grams per square yard; and (C) Example V (cellulosic, airlay, basis weight 80 grams per square yard).

They were treated using the "printing process" as previously described with an impregnating solution consisting of the following:

| | |
|---|---|
| Propylene Glycol U.S.P. | 52.25% |
| Quaternary Ammonium (BTC 2125M by Stepan) | 12.50% |
| Plurofac D-25 | 10.00% |
| Plurofac B-25-5 | 10.00% |
| Amine oxide | 10.00% |
| Cationic surfactant of Example I | 5.00% |
| Fragrance | 0.25% |
| Total: | 100.00% |

The above impregnating solution was added to each of the three webs at 10–12% of the basis weight of the web.

A cleaning efficiency test was run on the matrix identified in category (C) above (the matrix of Example V). The results are reported in column ii, Table 3. the cleaning efficiency was somewhat better for the detergent-/disinfectant that in detergent alone.

TABLE 3

COMPARATIVE CLEANING EFFICIENCY OF EXAMPLE V MATRIX CONTAINING DIFFERENT SOLUTIONS

Number of Wipings Required to Clean and Dry

| Surface | (i) Control KMM (oil) | (ii) Detergent/Disinfectant Airlay Nonwoven KMM (oil) | (iii) Detergent Airlay Nonwoven KMM (oil) |
|---|---|---|---|
| Ceramic Tile (Textured) | 2.2 (2.2) | 3.2 (4.0) | 5.8 (5.0) |
| Ceramic Tile | 2.4 (2.2) | 2.8 (3.4) | 3.4 (6.6) |

TABLE 3-continued

COMPARATIVE CLEANING EFFICIENCY OF EXAMPLE V MATRIX CONTAINING DIFFERENT SOLUTIONS

Number of Wipings Required to Clean and Dry

| Surface | (i) Control KMM (oil) | (ii) Detergent/Disinfectant Airlay Nonwoven KMM (oil) | (iii) Detergent Airlay Nonwoven KMM (oil) |
|---|---|---|---|
| (Smooth) | | | |
| Formica | 2.8 (3.0) | 3.8 (4.6) | 3.6 (4.6) |
| Linoleum | 3.0 (2.8) | 4.0 (3.4) | 4.4 (4.2) |
| Average | 2.6 (2.6) | 3.5 (3.9) | 3.8 (5.1) |
| Dry | +2.0 (+2.0) | +0 (+0) | +0 (+0) |

Control: HandiWipe ® and Joy ® dishwashing liquid in water.
(oil) = oil
KMM = ketchup, mustard, mayonnaise

EXAMPLE VII

To verify that an antimicrobial agent such as BTC 2125M by Stepan Chemical would in fact be active, a test for the antimicrobial activity was performed on treated matrices identified as categories A, B and C in Example VI above and were least 30 days old. The results are listed in Table 4.

TABLE 4

ZONE OF INHIBITION
REPORT OF EVALUATION OF NON-WOVEN MATERIAL TREATED WITH CATIONIC (ANTIMICROBIAL) AGENTS

| Sample Description | Untreated Wiper "A" | Untreated Wiper "B" | Untreated Wiper "C" | Liquid Detergent/ Disinfectant Formula "B" | Formula "B," Wiper "A" | Formula "B," Wiper "B" | Formula "B," Wiper "C" |
|---|---|---|---|---|---|---|---|
| *Staphylococcus aureus* | None | None | None | 15 mm. | 12 mm. | 11 mm. | 15 mm. |
| *Escherichia coli* | None | None | None | 10 mm. | 10 mm. | 10 mm. | 10 mm. |
| *Pseudomonas cepacia* | None | None | None | 13 mm. | 8 mm. | 10 mm. | 12 mm. |
| *Salmonella typhimurium* | None | None | None | 11 mm. | 10 mm. | 10 mm. | 10 mm. |
| *Candida albicans* | None | None | None | 8 mm. | 8 mm. | 8 mm. | 8 mm. |
| Penicullium & Aspergillus | None | None | None | 8 mm. | 8 mm. | 8 mm. | 8 mm. |

NOTE
NONE: No ability to inhibit growth of bacteria
mm.: An ability to inhibit growth of bacteria;
Wiper "A": Rayon Fiber, Hydro-entangled, basis weight: 90 gr./square yard
Wiper "B": Cellulosic Fiber, Airlay, basis weight: 35–40 gr./square yard
Wiper "C": Cellulosic Fiber, Airlay, basis weight: 80 gr./square yard The test results set forth in Table 4 above were designed to show the effectiveness of anti-microbials or bacteriastats by placing these products in the center of a dish containing actively growing bacteria.

The products, once moistened and placed in the center of this actively growing bacterial colony, are left in contact for a period of time.

If the product placed there has no anti-microbial activity, the bacteria will grow over it and this is reported as "O" or none in the test report.

This is the response listed next to the untreated substrates.

If the product has anti-microbial activity, the bacteria die and do not overgrow this area. The greater the anti-microbial activity, the larger the "dead" zone is. This is referred to as the zone of inhibition.

This response if listed under treating solutions and usually shows the highest zones.

When the treating solution is added to the webs or matrices, the activity of the anti-microbials is reduced because the active chemical tends to attack the fibers and is then unable to attack the bacteria.

The responses listed under treated wipes show very close activity to the treating solution as seen in the size of the zones of inhibition. This is unusual and indicates that the anti-microbial chemicals were prevented from attacking the fibers and were essentially held in a "ready" state for use against the bacteria.

The results listed in Table 4 show that the dry untreated wipers show no antimicrobial effects; that the actual impregnating solution does show antimicrobial activity; and that the treated wipers show effects almost identical to the pure impregnating solution. These results support the conclusion that this product is unique and that the activity of an antimicrobial agent such as BTC 2125M is not greatly reduced during contact with a cellulosic web. The results are unexpected because the state of the prior art teaches that in like situations, there are generally losses of about 50% of the formulate amount of active disinfecting agent as a result of interaction of the agent with the cellulosic fibers.

To confirm this, chemical analysises of the levels of BTC 2125M were performed and found that 0.60% of the formulated 0.625% was recoverable.

EXAMPLE VIII

Further tests were performed to establish the level of potential toxicity of this detergent (Example V matrix) and detergent/disinfectant (Example V, category C matrix) products. Both tests were conducted on the matrix described in category "C" of Example VI (i.e., cellulosic, airlay, 80 gram/square yard).

The results, listed in Table 5, show that unexpectedly, the present invention enables a product which contains strong irritating and potentially toxic chemicals to yield a safe, non-irritating, non-toxic wiper.

Therefore, this product can be used safely in homes with children or adults who cannot read or understand hazardous warnings. The product can deliver the accurate amount of detergent and/or disinfectant to the specific surface requiring it without causing potentially irritating chemicals to be available to non-professional users.

TABLE 5

SUMMARY OF PRODUCT SAFETY RESULTS

| Product | Test | Results |
|---|---|---|
| Detergent/Disinfectant Wipe (Ex. VI, Matrix C) | Acute Oral Toxicity, rats, FHSA | Category IV, no deaths |
| Detergent/Disinfectant Wipe (Ex. VI, Matrix C) | Eye Irritation, rabbits, EPA | Category III, slight conjunctival irritation |
| Detergent/Disinfectant Wipe (Ex. VI, Matrix C) | Primary Dermal Irritation rabbits, EPA | Category IV, Primary Irritation Index 0 at 48 hours, 0.83 at 5 hours, 0.33 at 24 hours |
| Detergent Wipe (Ex. V) | Acute Oral Toxicity, rats, FHSA | Not toxic, LD 50 5 g./Kg. |
| Detergent Wipe (Ex. V) | Eye Irritation, rabbits, EPA | Non-irritant, Primary (all 0) |
| Detergent Wipe (Ex. V) | Primary Dermal Irritation rabbits, FHSA | Non-irritant, Primary Irritation Index 0 |
| Detergent Disinfectant Wipe (Ex. VI, Matrix C) | Acute Oral Toxicity, rats, FHSA | Not toxic LD 50 5 g./Kg. |
| Detergent/Disinfectant Wipe (Ex. VI, Matrix C) | Eye irritation, rabbits EPA | Indeterminate (Test 1); Non-irritant (Test 2) |
| Detergent/Disinfectant Wipe (Ex. VI, Matrix C) | Primary Dermal Irritation rabbits, FHSA | Non-irritant, Primary Irritation Index 0.25 |

The "Results" column found in Table 5 above cites toxicity categories set by the E.P.A. Toxicity Category chart, and excerpt of which is set forth in Table 6 below, as stated in 40 C.F.R. 162.10(h)(1) and by tests established by the Federal Hazardous Substances Act (FHSA).

TABLE 6

EPA TOXICITY CATEGORY CHART

Categories are assigned on the basis of the highest hazard shown by any of the indicators in the table below:

| HAZARDOUS INDICATORS | TOXICITY CATEGORIES I | II | III | IV |
|---|---|---|---|---|
| Oral $LD_{50}$ | Up to and including 50 mg/kg | From 50 thru thru 500 mg/kg | From 500 through 5000 mg/kg | Greater than 5000 mg/kg |
| Inhalation $LC_{50}$ | Up to and including 0.2 mg/liter | From 0.2 thru 2 mg/liter | From 2 thru 20 mg/liter | Greater than 20 mg/liter |
| Dermal $LD_{50}$ | Up to and including 200 mg/kg | From 200 thru 2000 mg/kg | From 2000 thru 20,000 | Greater than 20,000 |
| Eye Effects | Corrosive; corneal opacity not reversible within 7 days | Corneal opacity reversible within 7 days; irritation persisting for 7 days | No corneal opacity; irritation reversible within 7 days | No irritation |
| Skin Effects | Corrosive | Severe irritation at 72 hours. | Moderate irritation at 72 hours | Mild or slight irritation at 72 hours |

What is claimed is:

1. A method of making a substantially flexible dry matrix capable of removing dust, organic film or both, to which no water has been added other than that naturally present therein, which comprises passing a continuous line of a matrix material comprising (a) natural or synthetic woven, non-woven or knitted fibers, or (b) flexible foam material or combinations thereof between an engraved roll and a smooth roll, said engraved roll containing a non aqueous treatment solution on the surface thereof; coating said matrix material with an effective amount of a non-aqueous treatment solution sufficient to allow said matrix to retain its substantially flexible dry characteristics and to remove said dust and organic film; said non-aqueous treatment solution comprising by weight between about 25% and 75% of at least one glycol compounds and between about 0.2% and 60% of a cationic surfactant.

2. The method defined in claim 1, wherein said matrix is coated with between about 1% and 99% of said treatment solution calculated on the basis weight of said matrix.

3. The method defined in claim 2 wherein said matrix is coated with between about 3% and 25% of said treatment solution calculated on the basis weight of said matrix.

4. The method defined in claim 3 which contains effective amounts of at least one fragrance.

5. The method defined in claim 3 wherein said matrix comprises a polyolefin.

6. The method defined in claim 3 wherein said matrix comprises a polyester.

7. The method defined in claim 3 wherein said matrix comprises nylon.

8. The method defined in claim 3 wherein said matrix comprises a cellulosic.

9. The method defined in claim 3 wherein said matrix comprises a cotton.

10. The method defined in claim 3 wherein said matrix comprises rayon.

11. The method defined in claim 3 wherein said matrix comprises hemp.

12. The method defined in claim 3 wherein said matrix comprises polyester foam.

13. The method defined in claim 3 wherein said matrix comprises a polyurethane foam.

14. The method defined in claim 3 wherein said matrix comprises polypropylene fibers coated with between about 3% and 12% of said treatment solution which comprises approximately 40 to 60% propylene glycol and, correspondingly, approximately 40 to 60% of a cationic surfactant.

15. The method defined in claim 3 wherein said matrix comprises polypropylene and rayon fibers coated with between about 3% and 12% of said treatment solution comprising approximately 40% to 60% propylene glycol and correspondingly approximately 40% to 60% of a cationic surfactant.

16. The method defined in claim 3 wherein said matrix is polypropylene, and said treatment solution comprises about 49% propylene glycol and about 49% of a cationic surfactant.

17. The method defined in claim 3 wherein said cationic surfactant compound is selected form the group consisting of water soluble quaternary ammonium compounds and polymeric quaternary ammonium compounds of the general formula:

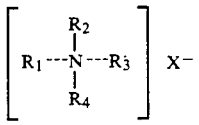

wherein $R_1$ and $R_2$ are selected from an alkyl group, an alkyl ether group and a hydroxyalkyl group, each containing from 1 to 3 carbon atoms, $R_3$ is an alkyl group containing from 6 to 20 carbon atom, and $R_4$ is selected from an alkyl group containing 6 to 20 carbon atoms, an aralkyl group wherein alkyl contains 1 to 2 carbon atoms and heterocyclic radicals; and $X^-$ is a suitable anion selected from the group consisting of halide, chloride, bromide, iodide, nitrate, methosulfate or acetate.

18. The method defined in claim 1 wherein said matrix is selected from the group consisting of polypropylene, polyester, nylon, cotton, hemp rayon fibers and polyurethane foam, polyether foam and polyester foam.

19. The method defined in claim 18 wherein said quaternary ammonium compound has the general formula $C_{8-18}$, alkyl dimethyl ammonium chlorides and mixtures thereof.

20. The method defined in claim 18 wherein the matrix is polypropylene and the cationic surbactant in said treatment solution is (a) between about 40% and 60% of a quaternary ammonium compound having the general formula:

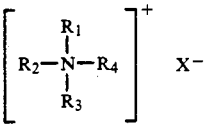

wherein $R_1$ and $R_2$ are alkyl groups having 1–3 carbon atoms; $R_3$ is an alkyl benzyl group where the alkyl group has 6–22 carbon atoms; $R_4$ is polypropylene oxide group and (b) about 5% to 20% of an alkyl phenyl ethoxylate nonionic surfactant.

21. The method defined in claim 18 wherein the matrix is rayon and the cationic surfactant in said treatment solution is (a) between about 40% and 60% of a quaternary ammonium compound having the general formula:

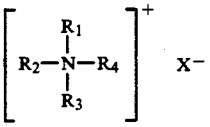

wherein $R_1$ and $R_2$ are alkyl groups having 1–3 carbon atoms; $R_3$ is an alkyl benzyl group where the alkyl group has 6–22 carbon atoms; $R_4$ is a polypropylene oxide group; and (b) about 5% to 20% of an alkyl phenyl ethoxylate nonionic surfactant.

22. The method defined in claim 18 wherein the matrix is cellulosic and the cationic surfactant in said treatment solution is (a) between about 40% and 60% of a quaternary ammonium compound having the general formula:

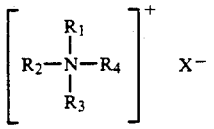

wherein $R_1$ and $R_2$ are alkyl groups having 1–3 carbon atoms; $R_3$ is an alkyl benzyl group where the alkyl group has 6–22 carbon atoms; $R_4$ is a polypropylene oxide group; (b) and about 5% to 20% of an alkyl phenyl ethoxylate nonionic surfactant.

23. The method defined in claim 18 wherein the matrix is comprised of a layer of cellulose fibers sandwiched between layers of polypropylene fibers and the cationic surfactant in said treatment solution is (a) between about 40% and 60% of a quaternary ammonium compound having the general formula:

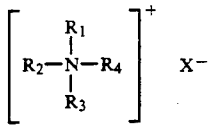

wherein $R_1$ and $R_2$ are alkyl groups having 1–3 carbon atoms; $R_3$ is an alkyl benzyl group where the alkyl group has 6–22 carbon atoms; $R_4$ is polypropylene oxide; and (b) about 5% to 20% of an alkyl phenyl ethoxylate nonionic surfactant.

24. The method defined in claim 1 wherein the treatment solution contains up to 45% of a nonionic surfactant selected from the group consisting of:

(a) the polyethylene oxide condensates of alkyl and dialkyl phenols, having a straight or branched alkyl group of from about 6 to 12 carbon atoms, with ethylene oxide, wherein the amount of ehtylene oxide present is from about 3 to about 25 moles per mole of alkyl phenol;

(b) the condensation products of aliphatic alcohols with ethylene oxide of the formula $RO(C_2H_4O)_nH$ and/or propylene oxide of the formula $RO(C_3H_6O)_nH$: wherein in either or both cases R is a straight or branched alkyl group having from about 8 to about 22 carbon atoms, and n is 3 to 40; and (c) polyoxyethylene-polyoxypropylene block polymers.

25. The method defined in claim 24, wherein said matrix has been coated with between about 1% and 99% of said treatment solution calculated on the basis weight of said matrix.

26. The method defined in claim 24 wherein said matrix has been coated with between about 3% and 25% of said treatment solution calculated on the basis weight of said matrix.

27. The method defined in claim 26 wherein the treatment solution contains effective amounts of at least one fragrance.

28. The method defined in claim 26 wherein said treatment solution contains between about 0.1% and 5% fragrance.

29. The method defined in claim 26 wherein said matrix comprises a polyolefin.

30. The method defined in claim 26 wherein said matrix comprises a polyester.

31. The method defined in claim 26 wherein said matrix comprises nylon.

32. The method defined in claim 26 wherein said matrix comprises a cellulosic.

33. The method defined in claim 26 wherein said matrix comprises a cotton.

34. The method defined in claim 26 wherein said matrix comprises rayon.

35. The method defined in claim 26 wherein said matrix comprises hemp.

36. The method defined in claim 26 wherein said matrix comprises polyester foam.

37. The method defined in claim 26 wherein said matrix comprises a polyurethane foam.

38. The method defined in claim 26 wherein said matrix comprises polypropylene fibers coated with between about 3% and 12% of said treatment solution which comprises up to 60% propylene glycol and approximately 5% to 25% of a cationic surfactant and up to 45% nonionic surfactant.

39. The method defined in claim 26 wherein said matrix comprises polypropylene and rayon fibers coated with between about 3% and 12% of said treatment solution comprising up to 60% propylene glycol and correspondingly approximately 5% to 25% of a cationic surfactant and up to 45% of a nonionic surfactant.

40. The method defined in claim 26 wherein said cationic surfactant compound is selected from the group consisting of water soluble quaternary ammonium compounds and polymeric quaternary ammonium compounds of the general formula:

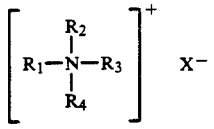

wherein $R_1$ and $R_2$ are selected from an alkyl group, an alkyl ether group and a hydroxyalkyl group each containing from 1 to 3 carbon atoms, $R_3$ is an alkyl group containing from 6 to 20 carbon atoms, and $R_4$ is selected from an alkyl group containing 6 to 20 carbon atoms, an aralkyl group wherein alkyl contains 1 to 2 carbon atoms and heterocyclic radicals, and $X^-$ is a suitable anion halide, selected from the group consisting of chloride, bromide, iodide, nitrate, methosulfate or acetate.

41. The method defined in claim 40 wherein said matrix is selected from the group consisting of polypropylene, polyester, nylon, cotton, hemp, rayon fibers and polyurethane foam, polyether foam and polyester foam.

42. The method defined in claim 41 wherein said quaternary ammonium compound has the general formula $C_{8-18}$ alkyl dimethyl benzyl ammonium chlorides and mixtures thereof.

43. The method defined in claim 41 wherein the matrix is polypropylene and said treatment solution is up to 60% of propylene glycol and 45% nonionic surfactant and correspondingly 5–25% of quaternary ammonium compound having the general formula:

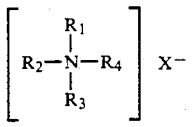

wherein $R_1$ and $R_2$ are alkyl groups having 1-3 carbon atoms; $R_3$ is an alkyl benzyl group where the alkyl group has 6-22 carbon atoms; $R_4$ is polypropylene oxide group.

44. The method defined in claim 41 wherein the matrix is rayon and said treatment solution is up to 60% of propylene glycol and 5-25% of a nonionic surfactant and up to 45% of a quaternary ammonium compound having the general formula:

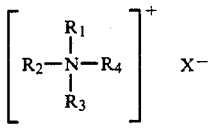

wherein $R_1$ and $R_2$ are alkyl groups having 1-3 carbon atoms; $R_3$ is an alkyl benzyl group where the alkyl group has 6-22 carbon atoms; $R_4$ is a propylene oxide group; and about 5% to 20% of an alkyl phenyl ethoxylate nonionic surfactant.

45. The method defined in claim 41 wherein the matrix is cellulosic and said treatment solution is up to 60% propylene glycol, 5-25% of a nonionic surfactant and between about 40% and 60% of a quaternary ammonium compound having the general formula:

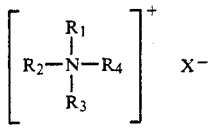

wherein $R_1$ and $R_2$ are alkyl groups having 1-3 carbon atoms; $R_3$ is an alkyl benzyl group where the alkyl group has 6-22 carbon atoms; $R_4$ is a polypropylene oxide group.

46. The method defined in claim 41 wherein the matrix is comprised of a layer of cellulose fibers sandwiched between layers of polypropylene fibers and said treatment solution is up to 60% propylene glycol; 5-25% of nonionic surfactant and between about 40% and 60% of a quaternary ammonium compound having the general formula:

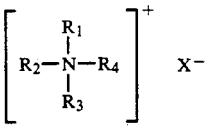

wherein $R_1$ and $R_2$ are alkyl groups having 1-3 carbon atoms; $R_3$ is an alkyl benzyl group where the alkyl group has 6-22 carbon atoms; $R_4$ is a polypropylene oxide group.

47. The method defined in claim 2 wherein said smooth roll is a smooth rubber roll under pressured nip contact.

48. The method defined in claim 47 wherein said engraved roll contains a plurality of cells that determine the volume of treatment solution picked up and held in said cells prior to coating said matrix material.

49. The method defined in claim 1 wherein said engraved roll is partially submerged in said treatment solution and said roll rotates therethrough causing said solution to fill the cells comprising the engraved portions of said engraved roll.

50. The method defined in claim 1 wherein excess solution accumulating above the plane of the engraving roll is removed by a doctor blade.

* * * * *